US005642772A

United States Patent [19]

Charpentier et al.

[11] Patent Number: 5,642,772

[45] Date of Patent: Jul. 1, 1997

[54] PROCESS AND DEVICE FOR CORRECTING THE OVALIZATION OF ROLLS FOR THE CONTINUOUS CASTING OF METAL STRIP

[75] Inventors: Jacques Charpentier, Saint Julien de Ratz; Marcel Cortes, Froges, both of France

[73] Assignee: Pechiney Rhenalu, Courbevoie, France

[21] Appl. No.: 500,155

[22] Filed: Jul. 10, 1995

[30] Foreign Application Priority Data

Jul. 29, 1994 [FR] France ..... 94 09667

[51] Int. Cl.[6] ..... B22D 11/124; B22D 11/06; B22D 11/12

[52] U.S. Cl. ..... 164/485; 164/428; 164/448; 164/442; 164/443

[58] Field of Search ..... 164/443, 442, 164/441, 447, 448, 348, 428, 429, 485, 484, 479, 128

[56] References Cited

U.S. PATENT DOCUMENTS 4,671,340 6/1987 Larrecq et al. ..... 164/428

4,944,342 7/1990 Lanener ..... 164/485

FOREIGN PATENT DOCUMENTS 2217098 9/1974 France .

62-168650 7/1987 Japan ..... 164/442

1560376 4/1990 U.S.S.R. ..... 164/448

WO9211959 7/1992 WIPO .

WO9319874 10/1993 WIPO .

*Primary Examiner*—Joseph J. Hail, III

*Assistant Examiner*—I.-H. Lin

*Attorney, Agent, or Firm*—Dennison, Meserole, Pollack & Scheiner

[57] ABSTRACT

A process and apparatus for cooling the external surface of rolls used in continuous casting of metal strip. According to the invention, the direction of cooling fluid flowing through the rolls is periodically reversed in order to reduce the thermal ovalization of the rolls.

10 Claims, 2 Drawing Sheets

PROCESS AND DEVICE FOR CORRECTING THE OVALIZATION OF ROLLS FOR THE CONTINUOUS CASTING OF METAL STRIP

BACKGROUND OF THE INVENTION

1. Field of the Invention

The invention relates to a process and a device for correcting the thermal ovalisation (or out-of round state) appearing on rolls for the continuous casting of metal strip.

2. Description of Related Art

A machine for the continuous casting of metal strip generally comprises two identical rolls located face to face, separated by a space having the thickness of the metal strip to be produced and rotating in opposite directions to one another.

The liquid metal is supplied from one side of the space whereas the strip leaves from the other side at its nominal thickness.

Strips ranging from a few centimetres in thickness to several millimetres or less can be produced with such a device.

FIGS. 1 (longitudinal section) and 2 (cross section) show the general structure of a roll.

It comprises at (1) a roll body (central portion) which is surrounded by a shell (2) which receives the molten metal and serves to roll the strip. It is therefore necessary to cool the assembly.

Cooling is usually carried out by a coolant (generally water) circulating in at least one cooling circuit located inside the roll body (1).

This circuit comprises at least one cold water supply hole (3) in the form of a tube pierced in the roll body (1) parallel to its axis, opening at the exterior through one of its ends, the other end being blocked, and extending in line with the shell (2) over its entire width.

A plurality of smaller diameter tubes (4) connects each supply hole (3) to a distributing manifold (5) in the form of a groove located beneath the shell (2) and substantially parallel to the supply tube (3); each manifold supplies water to an actual cooling device comprising a network of small channels (5) machined at the peripheral surface of the roll body (1) and located beneath the shell in a transverse plane; the water circulates there, makes thermal contact with the shell and cools it.

After the water has been heated it is discharged by means of a device identical to the supply device. It comprises (see bottom part of FIG. 1 and FIG. 2) a manifold (7) for the discharging of hot water and a plurality of small diameter tubes (8) connecting it to the discharge tube (9).

A roll body usually comprises two or three or four water supply circuits and as many discharge circuits interconnected by the channels (6) of the cooling device. The reciprocal arrangement of the cold water and hot water circuits is shown clearly in particular in FIG. 2 which shows the case of two circuits. The figure shows their interconnection and their alternate arrangement, offset from one another by 90°. The arrows illustrate the direction of circulation of the water. In the cases of three or four circuits, the offset is 60° or 45°.

Thus, the cold water arriving in one of the distributing manifolds (5) is then dispersed in the cooling channels (6) situated on either side of the manifold (5), is heated and is discharged through the manifolds (7) which therefore recover the water originating from two distributing manifolds (5) located on either side.

With such an arrangement of the cooling circuits, cold and hot regions appear in the shell and the roll in the vicinity of the manifolds and tubes for the supply of cold water and discharge of hot water.

This diversity in temperature which can attain 4° C. causes expansion, leading to deformation of the roll known as ovalisation or out-of round state.

This out-of-round state will be manifested by cyclic irregularities in the thickness of the cast metal strip and will therefore affect the quality thereof; the thinner the cast strip, the more inconvenient this defect.

These temperature deviations should therefore be eliminated or minimized to improve the quality and evenness in the thickness of the cast strip. Furthermore, the applicants have sought a process and a device for reducing the temperature deviations in the roll, which are effective and easy to produce or carry out and are inexpensive.

SUMMARY OF THE INVENTION

In a first aspect, the invention is a process for cooling rolls for the continuous casting of metal strip by means of a fluid, said metal rolls comprising a roll body and a metal shell consisting essentially of a metal tube or casing of which the internal face surrounds said roll body, the other face receiving liquid metal and producing the strip by cooperation of two rolls, said roll body comprising at least one cooling circuit opening at the exterior of the roll body through two inlet/outlet ends and comprising at least one cold fluid (generally water) supply device, an actual cooling device where the fluid is in thermal contact with the lower face of the shell and a device for the discharge of the fluid which is heated on contact with the shell characterised in that the direction of circulation of the fluid in the roll body is periodically reversed, the device for the supply of cold fluid becoming the device for the discharge of hot fluid and vice versa.

The invention is particularly suitable for rolls having the configuration described above with reference to FIGS. 1 and 2, their roll bodies comprising two or three or four alternate cold water supply devices with as many hot water discharge devices, these devices being offset by 90° (two devices), 60° (three devices) or 45° (four devices) and being connected by an actual cooling device.

As the continuous casting of strip generally takes place between two identical rolls, the reversal of direction of the coolant according to the invention is advantageously carried out on both rolls. Such a process is also applicable to casting on a single roll, for example film casting.

The process according to the invention is of particular interest when casting thin strips having a thickness, for example, of 1 to 12 mm or even thinner, specifically in the normal range of thicknesses from 5 to 12 mm where the process is very effective or again in the sphere of small thicknesses, for example of 1 to 5 mm, for which an out-of-round roll state is more harmful, the smaller the thickness. It is particularly suited to the casting of aluminium or aluminium alloy strip.

The frequency of reversal of the direction of circulation of water should be adjusted as a function of the characteristics of the installation, for example diameter of the rolls, flow rate of coolant, etc.

Better smoothing of the diversity in temperature in the rolls employing thick shells, for example between 20 and 100 mm thick, is obtained with the process according to the invention.

It is preferable to have identical fluid supply and discharge devices.

The maximum temperature deviation in a roll can therefore be limited to a few fractions of °C., allowing the out-of-round state to be eliminated almost completely and the constancy in thickness of the cast strips thus to be improved.

As an example, the process according to the invention has been applied to an installation for the continuous casting of aluminium strip having a thickness of 8 mm on rolls having an external diameter of 96 cm, of which the shell had a thickness of 8 cm, and having an internal cooling circuit identical to that shown in FIGS. 1 and 2.

In the absence of a reversal in the direction of the cooling water, a maximum temperature deviation of 4° C. was measured during the normal casting operation, causing variations in the thickness of the cast strip of 0.04 mm due to the out-of-round state of the rolls.

After having reversed the direction of the coolant at a frequency of every 5 minutes and employing the same rate as before, negligible (unmeasurable) variations in the thickness of the cast strip were obtained.

A second aspect of the invention is a device for reversing the direction of circulation of the coolant in at least one roll intended for continuous casting, in general of metal strip, as described above, that is to say containing at least one circuit for cooling with a fluid situated inside said roll, said circuit located in the roll opening at the exterior through two ends, characterised in that said device comprises:

a buffer basin containing said fluid, at least one pump withdrawing the fluid from it and supplying a fluid circuit, said fluid circuit comprising a first three-port valve of which a first port V1 is supplied by the pump, optionally by means of a flow meter B, a second port V2 is connected on the one hand to one of the ends of said cooling circuit and on the other hand to a first port W1 of a second three-port valve W, a third port V3 is connected on the one hand to the other end of said cooling circuit and on the other hand to a second port W2 of the valve W, the third port W3 of W being connected to a conduit for the discharge of the hot fluid.

The buffer basin can receive the hot fluid if it is sufficiently large to allow the cooling thereof or if it has a separate cooling device.

It can be seen that the valve V is assigned to the supply of cold fluid to the roll whereas the valve W is assigned to the discharge of the heated fluid.

The simultaneous manipulation of the three-port valves allows the direction of circulation of the fluid in the roll to be reversed without modifying the fluid circuit from the pump and for discharge to the basin.

These manipulations can advantageously be automated or controlled by a microprocessor, computer . . . etc.

If the casting machine comprises two rolls (upper and lower), the circuit for the supply of cold fluid to the second roll can be connected so as to branch from the port V2 or W1 of the respective valves V and W which already supply cold fluid to the first roll. Similarly, the circuit for discharge of hot fluid from said second roll can be branched from the port V3 or W2 of the respective valves V and W which already collect the hot fluid from the first roll.

However, to allow greater flexibility in control, it is preferable to use for the second roll a circuit identical to that supplying the first roll, these two circuits being able to form branch connections on the output of the pump.

DESCRIPTION OF THE PREFERRED EMBODIMENTS

Figure 1:
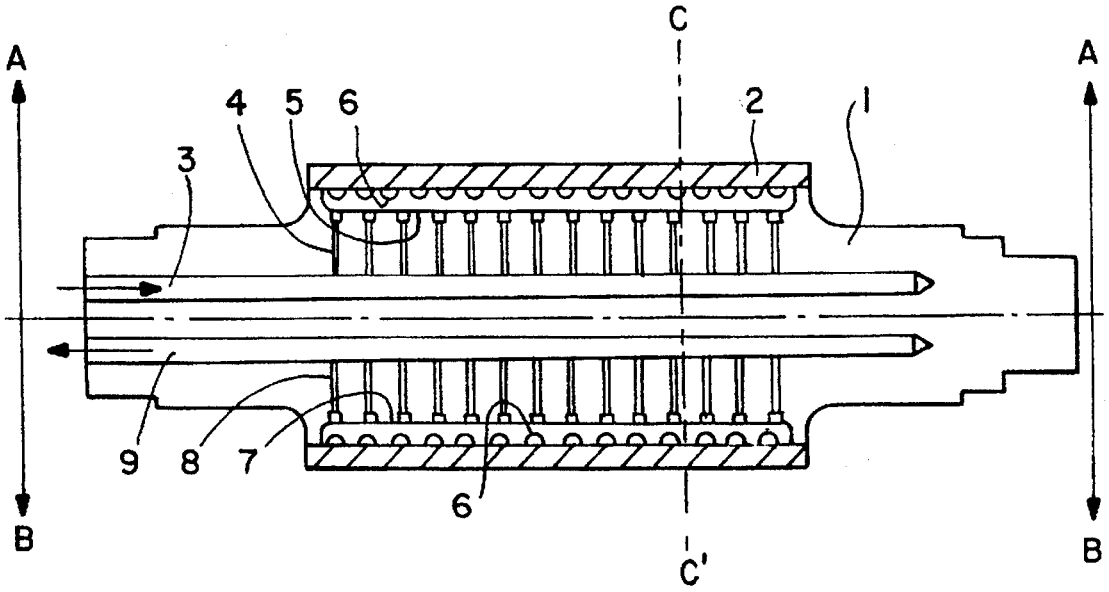
FIG. 1 is a longitudinal cross-sectional view of an internally cooled casting roll known to the prior art and used in the invention.
Figure 2:
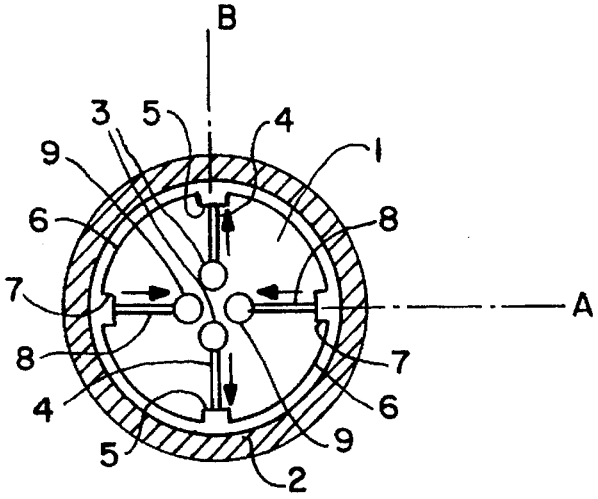
FIG. 2 is a lateral cross-sectional view of the roll of FIG. 1 along line C–C'.
Figure 3:
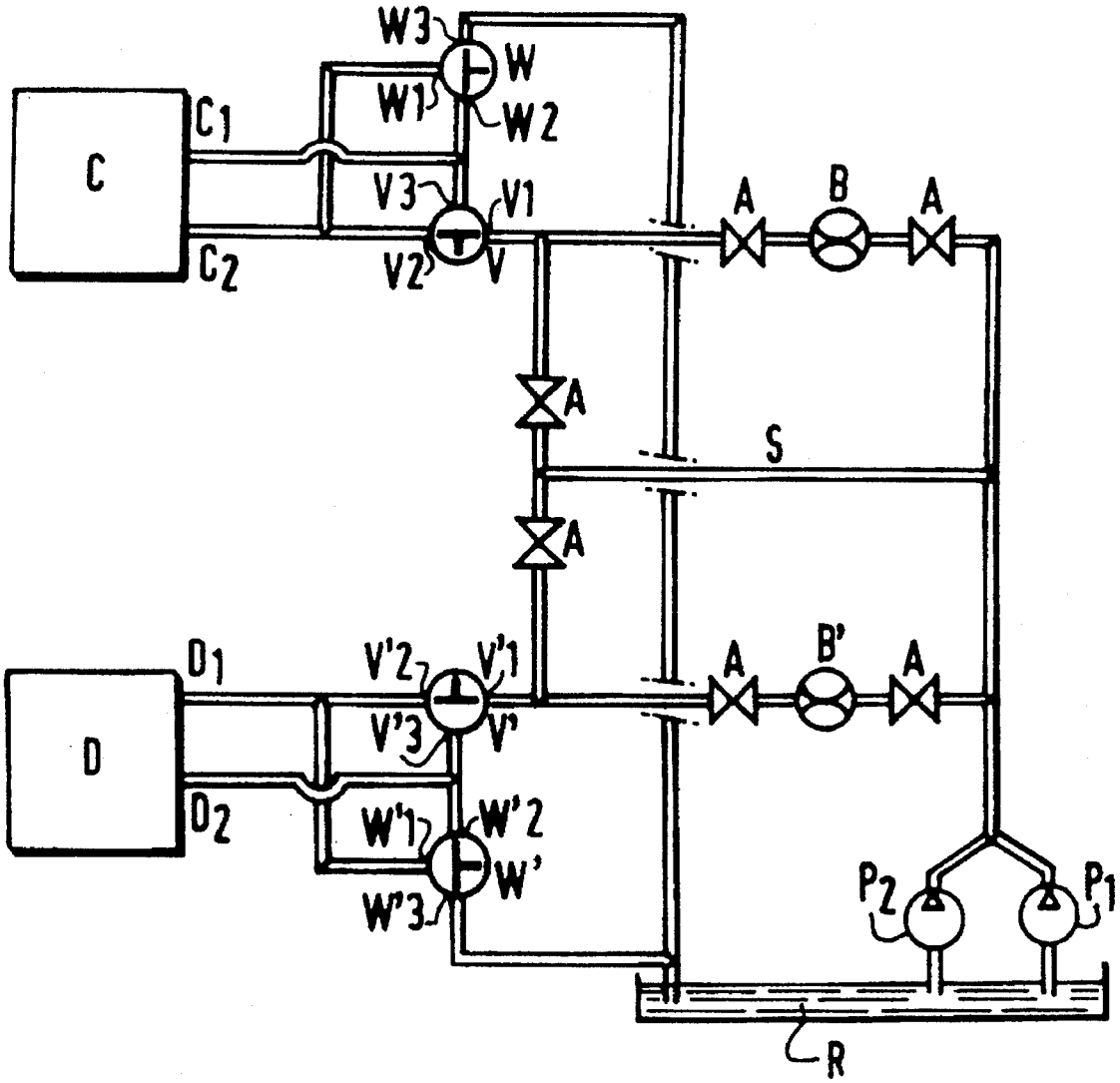
FIG. 3 is a schematic diagram of a cooling circuit according to the invention.

FIG. 3 shows a device according to the invention for a casting machine comprising two rolls: C (upper roll), D (lower roll). C1, C2 and D1, D2 show the inlet/outlet ends, which are interchangeable during the reversal of the fluid direction, of the circuit for cooling with fluid located at the respective interior of each of the rolls C and D.

Also shown are:

at R, the buffer basin of coolant, at P1 and P2, the two extraction pumps connected in parallel, at A, the stop valves at V and W, the three-port valves with their respective ports V1, V2, V3, W1, W2, W3; in particular it can be seen that V1 is connected to the output of pumps P by means of a flow meter B isolated by two stop valves (this flow meter can be short-circuited by a circuit S), that V2 and W1 are connected to the inlet/outlet point C2 of C whereas V3 and W2 are connected to the inlet/outlet point C1 and W3 is connected to the discharge of the fluid which returns to the basin R;

at V' and W', the references corresponding to the roll D; they have the same meaning and functions as for roll C.

What is claimed is:

1. In a process for continuous casting of metal strip between casting rolls, a process for cooling the casting rolls, wherein each said casting roll comprises an outer metal casing having an external face which contacts liquid metal for casting the strip and an internal face, a central roll body disposed within the outer metal casing adjacent said internal face, and a cooling circuit comprising a first cooling fluid port, a second cooling fluid port and a fluid connection means between said first and second ports which comprises said internal face;

said process for cooling comprising:

supplying cooling fluid to the roll through the first cooling fluid port, permitting the cooling fluid to be heated in contact with said internal face, and removing the heated cooling fluid from the roll through the second cooling fluid port;

stopping the flow of cooling fluid to the roll through the first cooling fluid port; and subsequently, supplying cooling fluid to the roll through the second cooling fluid port, permitting the cooling fluid to be heated in contact with said internal face, and removing the heated cooling fluid from the roll through the first cooling fluid port.

2. Process according to claim 1, wherein the steps of supplying cooling fluid to the roll comprise supplying the cooling fluid through a first longitudinal axial channel connected to the first cooling fluid port, passing the cooling fluid from the first longitudinal axial channel through a first plurality of smaller channels to a manifold disposed adjacent to said internal face, and passing the cooling fluid through a second plurality of smaller channels to a second longitudinal axial channel connected to the second cooling fluid port, the first and second longitudinal axial channels, the pluralities of smaller channels and the manifold constituting a cooling fluid supply means.

3. Process according to claim 2, wherein the steps of supplying cooling fluid to the roll comprise supplying the cooling fluid to two said cooling fluid supply means offset by 90°.

4. Process according to claim 2, wherein the steps of supplying cooling fluid to the roll comprise supplying the cooling fluid to three said cooling fluid supply offset by 60°.

5. Process according to claim 2, wherein the steps of supplying cooling fluid to the roll comprise supplying the cooling fluid to four said cooling fluid supply means offset by 45°.

6. Apparatus for reversing the direction of coolant flowing to an internally cooled roll for continuous casting of metal strip and including an internal cooling circuit with first and second external ports, said apparatus being an external cooling circuit comprising a reservoir for containing cooling fluid, a pump for supplying cooling fluid to the cooled roll, a first three-way valve V having ports $V_1$, $V_2$ and $V_3$, a second three-way valve W having ports $W_1$, $W_2$ and $W_3$, and connection means between the three-way valves and the pump and the three-way valves and the cooled roll, such that:

port $V_1$ is connected to the pump;

port $V_2$ is connected to port $W_1$ and has connection means to the first external port;

port $V_3$ is connected to port $W_2$ and has connection means to the second external port;

port $W_3$ is connected to the reservoir; whereby, in a first embodiment, cooling fluid flows from the pump through ports $V_1$ and $V_2$ to the first external port and from the second external port through ports $W_2$ and $W_3$ to the reservoir, and in a second embodiment, cooling fluid flows from the pump to through ports $V_1$ and $V_3$ to the second external port and from the first external port through ports $W_1$ and $W_3$ to the reservoir.

7. Apparatus according to claim 6, adapted for supplying cooling fluid to two casting rolls, wherein said connection means comprise means for connection to two cooled rolls.

8. Apparatus according to claim 7, additionally comprising a second external cooling circuit connected in parallel with said external cooling circuit.

9. Apparatus according to claim 6, additionally comprising means to simultaneously adjust said three-port valves, to change between the first and second embodiments.

10. A continuous casting apparatus comprising:

a cooled roll comprising an outer metal casing having an external face which contacts liquid metal for casting the strip and an internal face, a central roll body disposed within the outer metal casing adjacent said internal face, and a cooling circuit comprising a first cooling fluid port, a second cooling fluid port and a fluid connection means between said first and second ports which comprises said internal face;

a cooling circuit comprising a reservoir for containing cooling fluid, a pump for supplying cooling fluid to the cooled roll, a first three-way valve V having ports $V_1$, $V_2$ and $V_3$, a second three-way valve W having ports $W_l$, $W_2$ and $W_3$, and connection means between the three-way valves and the pump and the three-way valves and the cooled roll, such that:

port $V_1$ is connected to the pump;

port $V_2$ is connected to port $W_1$ and to the first external port;

port $V_3$ is connected to port $W_2$ and to the second external port;

port $W_3$ is connected to the reservoir;

whereby, in a first embodiment, cooling fluid flows from the pump through ports $V_1$ and $V_2$ to the first external port and from the second external port through ports $W_2$ and $W_3$ to the reservoir, and in a second embodiment, cooling fluid flows from the pump to through ports $V_1$ and $V_3$ to the second external port and from the first external port through ports $W_1$ and $W_3$ to the reservoir.

* * * * *